US005671605A

United States Patent [19]

Helterbrand

[11] Patent Number: 5,671,605

[45] Date of Patent: Sep. 30, 1997

[54] REFRIGERANT RECOVERY SYSTEM

[75] Inventor: David Helterbrand, deceased, late of Garland, Tex., by Mark A. Helterbrand, executor

[73] Assignee: DaveCo Industries, Inc., Garland, Tex.

[21] Appl. No.: 528,619

[22] Filed: Sep. 15, 1995

[51] Int. Cl.[6] ..... F25B 47/00

[52] U.S. Cl. ..... 62/85; 62/292; 62/470; 62/77

[58] Field of Search ..... 62/475, 292, 470, 62/85, 195, 77

[56] References Cited

U.S. PATENT DOCUMENTS

| | | |
|---|---|---|
| 1,931,347 | 10/1933 | Gay . |
| 2,409,624 | 10/1946 | Granville . |
| 2,682,758 | 7/1954 | Harris . |
| 2,779,173 | 1/1957 | Wurtz . |
| 3,035,418 | 5/1962 | Wright . |
| 3,496,731 | 2/1970 | Sholtes . |
| 3,675,442 | 7/1972 | Swanson . |
| 4,146,372 | 3/1979 | Groth et al. . |
| 4,252,003 | 2/1981 | Eckard et al. . |
| 4,255,937 | 3/1981 | Ehrlich . |
| 4,319,461 | 3/1982 | Shaw . |
| 4,351,651 | 9/1982 | Courneya . |
| 4,505,128 | 3/1985 | Miller et al. . |
| 4,735,054 | 4/1988 | Beckey . |
| 5,042,271 | 8/1991 | Manz . |
| 5,050,401 | 9/1991 | Van Steenburgh, Jr. ..... 62/292 |
| 5,361,594 | 11/1994 | Young ..... 62/475 |

*Primary Examiner*—John M. Sollecito
*Attorney, Agent, or Firm*—Gregory M. Howison

[57] ABSTRACT

A refrigerant recovery system for recovering refrigerant from a cooling system is disclosed. A compressor (60) is provided having an oil drain outlet (66). An oil separator (50) is also provided for receiving incoming refrigerant before the refrigerant is drawn into the compressor (60). The oil separator has a helical coil (90) disposed in a heat exchange relationship with the oil separator (50) for receiving the refrigerant after the refrigerant is compressed by the compressor (60) and thereby cooling the refrigerant. A condenser coil (92) is also provided for receiving the refrigerant after the refrigerant has passed through the helical coil (90) and further cooling the refrigerant, causing it to condense. An aluminum base (100) is provided for dissipating heat from the condenser coil (92) and the oil separator (50) since the condenser coil (92) and the oil separator (50) are mounted directly on the aluminum base (100).

17 Claims, 3 Drawing Sheets

REFRIGERANT RECOVERY SYSTEM

TECHNICAL FIELD OF THE INVENTION

The present invention relates in general to an apparatus for recovering refrigerant from a refrigerant system and, more particularly, to a refrigerant recovery system which pre-cools refrigerant after it passes through a compressor and before it passes through a condenser.

BACKGROUND OF THE INVENTION

It is required by SAE standards that oil contamination in refrigerant pumped into the storage container for later purification and reuse be limited to less than 4,000 ppm. ASHRAE and ARI standards are similar but more stringent. It is therefore desirable not only to remove oil from refrigerant at the compressor outlet, but also to return this oil to the compressor sump to avoid or minimize service addition of oil to the compressor sump or repair of damage to the compressor due to lack of proper lubrication.

It has heretofore been proposed to employ a metal canister having an open internal volume coupled to the compressor outlet so that refrigerant vapor loses velocity within the canister and oil droplets fall by gravity to the lower portion of the canister. However, hot refrigerant vapor from the compressor outlet, contacting the cooler metal wall of the canister, causes condensation of refrigerant and interferes with proper oil separation. Typically, the oil separator has therefore been provided with a blanket heater to heat the canister walls in an effort to avoid refrigerant condensation within the canister. A float valve at the lower portion of the canister returns collected oil to the compressor inlet.

It has also been found desirable, upon termination of compressor operation, to bleed refrigerant from the compressor outlet or discharge line to the compressor inlet or suction line in order to pressurize the system oil separator at the compressor inlet, to provide for proper draining of collected oil, and also to ease subsequent starting of the compressor. However, it is necessary to limit the amount of refrigerant bled to the low pressure side of the compressor to avoid condensation of refrigerant and prevent "slugging" upon subsequent compressor operation.

SUMMARY OF THE INVENTION

The present invention disclosed and claimed herein comprises a refrigerant recovery system for recovering refrigerant from a cooling system. A compressor is provided for compressing the refrigerant to be recovered. An oil separator having a wall and ends is provided for receiving incoming refrigerant before the refrigerant is drawn into the compressor. The oil separator has a helical coil disposed in a heat exchange relationship with the wall of the oil separator for receiving the refrigerant after the refrigerant is compressed by the compressor, thereby cooling the refrigerant. A condenser coil is also provided for receiving the refrigerant after the refrigerant has passed through the helical coil and further cooling the refrigerant and causing it to condense. An aluminum cabinet base is also provided. The aluminum cabinet base dissipates heat from the oil separator and the condenser coil, both of which are mounted directly to the aluminum cabinet base.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
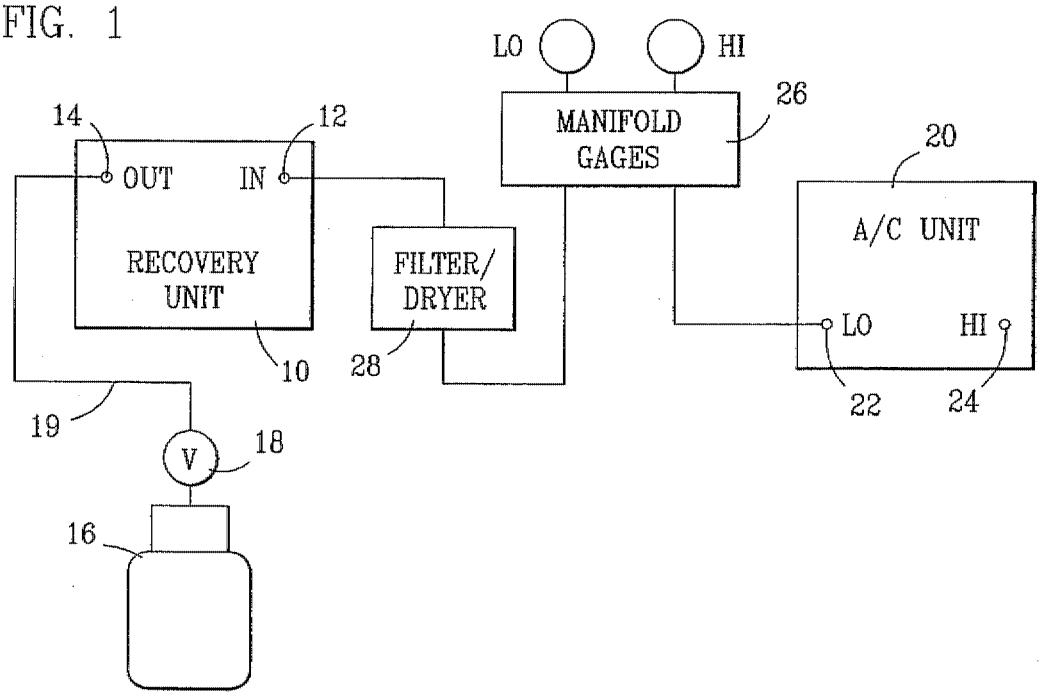
FIG. 1 illustrates a diagram of the system for vapor/liquid refrigerant recovery.

Referring now to FIG. 1, there is illustrated a diagram of the system for vapor/liquid refrigerant recovery. A recovery unit 10 is provided having an inlet valve 12 and an outlet valve 14. A recovery tank 16 is provided. The recovery tank 16 has a vapor inlet valve 18. An outlet hose 19 is provided and has one end thereof connected to the outlet valve 14 of the recovery unit 10 and the other end thereof connected to the vapor inlet valve 18 of the recovery tank 16. An air conditioning or cooling unit 20 is provided. The cooling unit 20 has a low pressure outlet 22 and a high pressure outlet 24. A set of manifold gauges 26 is provided. The manifold gauges 26 have a low side input and output and a high side input and output. The high side input of manifold gauges 26 is connected to the low side outlet 22 of the cooling unit 20. The low side output of the manifold gauges 26 is connected through a filter drier 28 to the inlet valve 12 of recovery unit 10.

In operation, all hoses are connected as shown in FIG. 1. The recovery tank 16 must be vacuumed prior to starting the recovery procedure if the recovery tank 16 has not been used before. To avoid contaminants from entering the recovery unit 10, a filter drier 28 must be used near the inlet valve 12 of the recovery unit 10. The filter drier 28 should be replaced after recovery of a contaminated system, or when the recovery time seems longer than normal. The next step is to open the valve on the low pressure outlet 22 of the cooling unit 20. Also, the low side valve of manifold gauges 26 must be opened. The inlet valve 12 and the outlet valve 14 of recovery unit 10 must also be opened. Any non-condensables must be bled from output hose 19 at the recovery tank 16. The vapor valve 18 on the recovery tank 16 must then be opened. At this time, the recovery unit 10 must be turned on. The low side gauge of the manifold gauges 26 must be monitored for pressure and vacuum readings. Once the low side gauge of manifold gauges 26 reaches the required in. Hg vacuum, the inlet valve 12 of recovery unit 10 should be closed. After this, a pause of five minutes must take place. If the low side gauge of the manifold gauges 26 now reads above 0 psig, the inlet valve 12 of recovery unit 10 must be opened and the procedure must be repeated until the low side gauge of manifold gauges 26 maintains a four in. Hg. After this has been reached, all valves must be closed and the recovery unit 10 must be switched off. Incoming oil must be drained after each recovery.

Figure 2A:
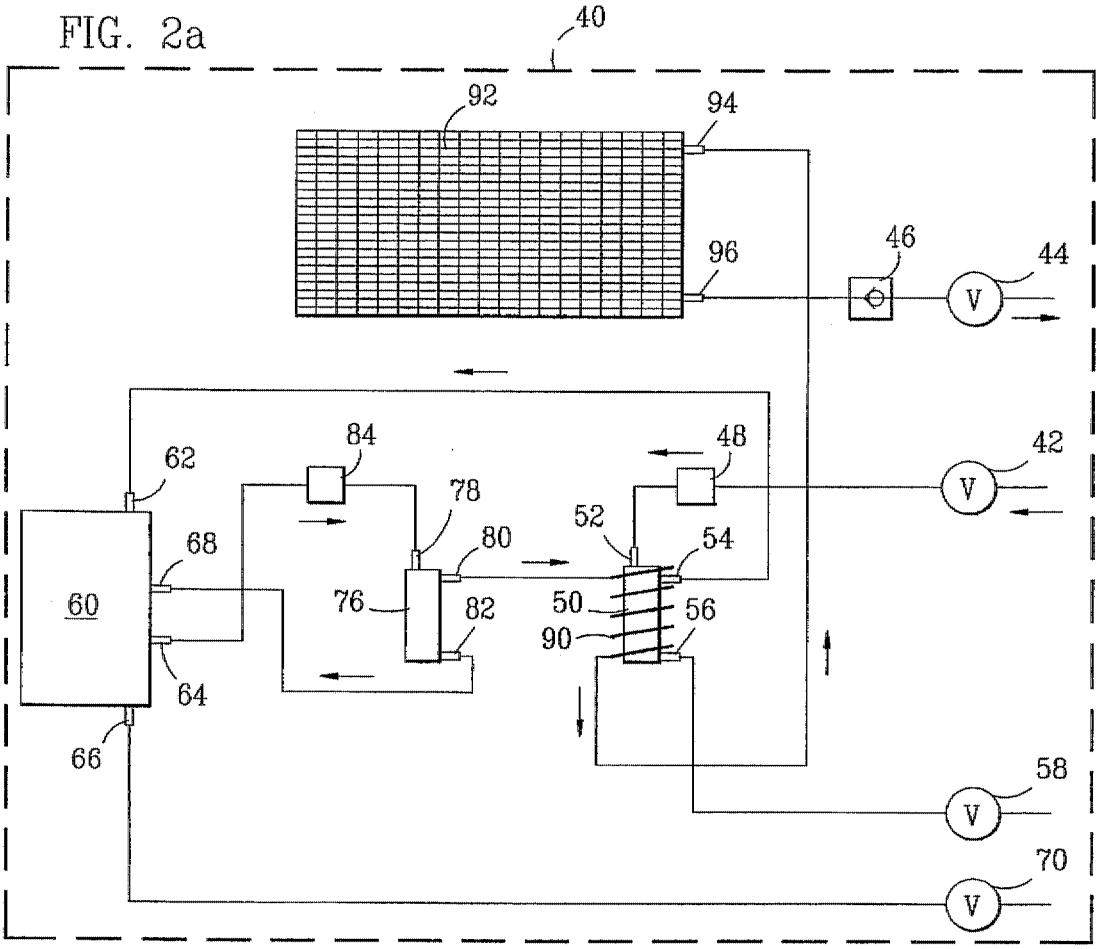
FIG. 2*a* illustrates a diagram of the system of the present invention.

Referring now to FIG. 2*a*, there is illustrated a diagram of a recovery unit 40. An inlet valve 42 and an output valve 44 are provided. A pressure regulator 48 is provided having an inlet and an outlet. The inlet of pressure regulator 48 is connected to inlet valve 42. The outlet of the pressure regulator 48 is set to a predetermined pressure, which is maintained by the pressure regulator 48. An incoming oil separator 50 is provided. Incoming oil separator 50 has an inlet 52 and an outlet 54. Incoming oil separator 50 also has an oil drain outlet 56. The outlet of pressure regulator 48 is connected to the inlet 52 of incoming oil separator 50. An incoming oil drain valve 58 is provided. Incoming oil drain valve 58 is connected to the oil drain outlet 56 of incoming oil separator 50. A compressor 60 is provided having an inlet 62 and an outlet 64. Compressor 60 also has an oil drain outlet 66 and an oil inlet 68. A compressor oil drain valve 70 is provided. The oil drain outlet 66 of compressor 60 is connected to the compressor oil drain valve 70. The outlet 54 of incoming oil separator 50 is connected to the inlet 62 of compressor 60. An oil separator/filter 76 is provided. The oil separator/filter 76 has an inlet 78, an outlet 80 and an oil drain valve 82. The outlet 64 of compressor 60 is connected through a pressure switch 84 to the inlet 78 of oil separator/filter 76. The pressure switch 84 provide over pressure protection, being operable to turn the compressor 60 off if a predetermined maximum pressure is exceeded by the refrigerant passing through the pressure switch 84. The oil drain outlet 82 of oil separator/filter 76 is connected to oil inlet 68 of compressor 60.

The incoming oil separator 50 comprises a closed canister having a substantially cylindrical side wall and axially opposed top and bottom walls. At least the canister side wall, and preferably the entire canister, is of heat-conductive construction. The incoming oil separator 50 has a helical coil 90 externally mounted on the side wall of the canister in a heat exchange relationship therewith throughout substantially the entire length of the canister. The incoming end of coil 90 is attached to the outlet 80 of the oil separator/filter 76. A condenser coil 92 is provided having an inlet 94 and an outlet 96. The outlet of coil 90 is connected to the inlet 94 of condenser coil 92. The outlet 96 of condenser coil 92 is connected through check valve 46 to output valve 44.

Figure 2B:
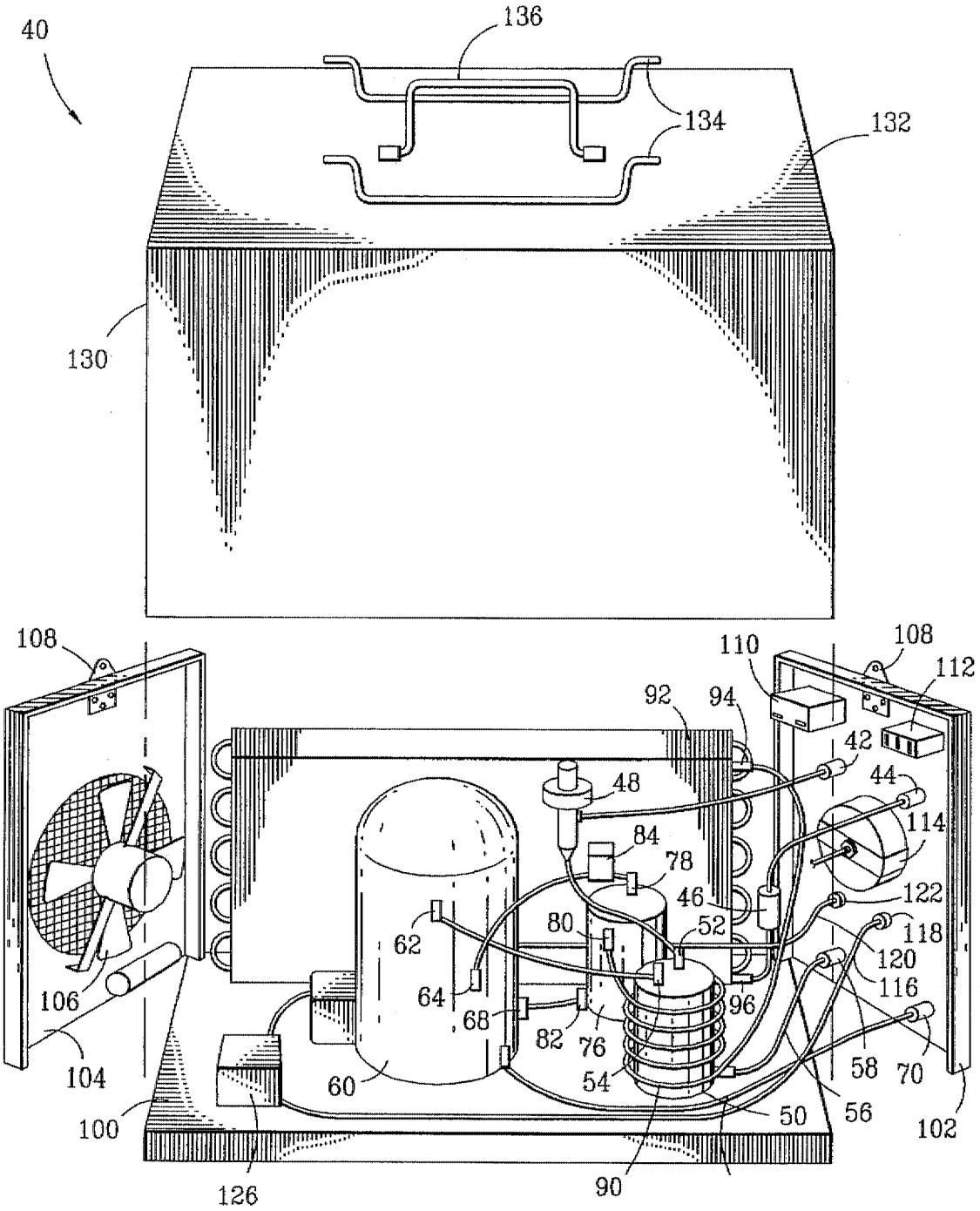
FIG. 2*b* illustrates an exploded diagram of the system of the present invention.

Referring now to FIG. 2*b*, there is illustrated an exploded diagram of the system of the present invention. All of the items shown and described in FIG. 2*a* are shown in FIG. 2*b*. In addition to those items illustrated in FIG. 2*a*, the following are additional items shown in FIG. 2*b*. An aluminum base 100 is provided. The aluminum base 100 is rectangular in shape. Mounted directly to the aluminum base 100 is the oil separator/filter 76 and the incoming oil separator 50. The incoming oil separator 50 and the oil separator/filter 76 are mounted in a heat-conductive relationship with the aluminum base 100. The compressor 60 is also mounted directly to the aluminum base 100. An aluminum front end panel 102 and an aluminum rear end panel 104 are both mounted perpendicular to the aluminum base 100 across the shorter ends of the aluminum base 100. Disposed in the aluminum rear end panel 104 is a fan 106. Also disposed in the aluminum rear end panel 104 in the top center portion, is a shoulder strap attachment 108. A shoulder strap attachment 109 is also attached in the center top portion of the aluminum front end panel 102. Disposed in the upper opposing corners of the aluminum front end is an hour counter 110 and an LED display 112. Attached to the center of the aluminum front end panel 102 is a pressure gauge 114. The inlet valve 42 and the output valve 44 are also disposed on the aluminum front end panel 102. Near the bottom opposing corners of the aluminum front end panel 102, the compressor oil drain valve 70 and the incoming oil drain valve 58 are disposed. A power cord 116 is provided. The power cord 116 runs through a hole 118 in the aluminum front end panel 102 so that it may be plugged into an electrical power outlet (not shown). A cut-off switch cord 120 is provided. The cut-off switch cord 120 runs through a hole 122 in the aluminum front end panel 102. A power supply 126 is provided. Connected to the power supply 126 is the power cord 116 and the cut-off switch cord 120. The power supply 126 is also connected to the compressor 60. An aluminum side panel 130 is provided. The aluminum side panel 130 is attached to the aluminum base 100 along its longest edge and is disposed perpendicular to aluminum base 100. A second aluminum side panel (not shown) is provided opposite of aluminum side 130 and has openings so that air may be drawn in or exhausted out through the condenser coil 92 which is disposed just inside of the second aluminum side panel (not shown). An aluminum top panel 132 is provided and is connected to aluminum side panel 130, the second aluminum side (not shown), the aluminum front end panel 102 and aluminum rear end panel 104. The aluminum top 132 is parallel and co-planar with aluminum base 100. The aluminum base 100, the aluminum front end panel 102, the aluminum rear panel 104, the aluminum side panel 130, the aluminum top panel 132 and the condenser coil 92 together define an enclosure. A cord wrap 134 is provided on the aluminum top panel 132 for wrapping the power cord 116 and the cut-off switch cord 120 when not in use. A carrying handle 136 is also provided for carrying the recovery unit 10.

In operation, the recovery unit 40 is connected to a refrigeration unit as shown in FIG. 1. The refrigerant is drawn in through inlet valve 42. The pressure of the refrigerant is regulated by pressure regulator 48. After passing through pressure regulator 48, the refrigerant passes through inlet 52 of incoming oil separator 50. Since the incoming oil separator 50 is a large open volume, the oil in the refrigerant is allowed to separate from the refrigerant. The oil falls to the bottom of the incoming oil separator 50 and then passes through the oil drain outlet 56. The oil may be drained through the incoming oil drain valve 58. After passing through incoming oil separator 50, the refrigerant moves through outlet 54 of incoming oil separator 50. The refrigerant then moves into the compressor 60 through the inlet 62. The refrigerant is compressed so that it becomes a hot vapor by compressor 60. At this time, oil may also separate from the refrigerant. The oil is collected at the bottom of the compressor 60 and may pass through oil drain outlet 66 and be drained through compressor oil drain valve 70. The velocity of the refrigerant vapor is reduced during passage through the compressor 60 as well as the incoming oil separator 50, permitting oil droplets to fall and collect in the lower portions. The refrigerant then passes through outlet 64 of compressor 60, through pressure switch 84 and into the oil separator/filter 76 through its inlet 78. As in compressor 60 and incoming oil separator 50, the oil is allowed to separate from the refrigerant and is also filtered. The oil then flows through oil drain outlet 82 and through oil inlet 68 of compressor 60, where the oil is reintroduced to the compressor so that it may pass through the oil drain outlet 66 of compressor 60 and be drained through the compressor oil drain valve 70. After passing through the oil separator/filter 76, the refrigerant passes through the outlet 80 of oil separator/filter 76 to a helical coil 90, which is positioned around and in a heat transfer relationship with incoming oil separator 50. The refrigerant vapor coming through the inlet 52 of incoming oil separator 50 is much cooler than the refrigerant flowing from the oil separator/filter 76. The incoming refrigerant flowing through the inlet 52 thereby cools the refrigerant passing through helical coil 90. A pre-cooling effect takes place as the refrigerant passes through the helical coil 90 around the incoming oil separator 50, with the walls of the incoming oil separator 50 cooled by the refrigerant passing into the inlet 52 and into the incoming oil separator 50. This pre-cooling operation shortens the time needed for the refrigerant to pass through the system.

After passing through the helical coil 90, the refrigerant passes through inlet 94 of condenser coil 92. Air passes through the condenser coil 92 pushed by fan 106 and draws heat away from the refrigerant. The air is expelled through openings in the second aluminum side panel (not shown). This is accomplished more quickly than normal since the refrigerant has already been pre-cooled by passing through helical coil 90 of incoming oil separator 50. After being cooled and condensed, the refrigerant passes through outlet 96, through check valve 46 and through output valve 44.

The incoming oil separator 50 and the oil separator/filter 76 are mounted directly to the aluminum base 100. The aluminum base 10panel 102, aluminum rear panel 102, aluminum rear end panel 104, aluminum side panel 130 and aluminum top panel 132 all dissipate heat from the oil separators which are mounted directly to the aluminum base 100. The condenser coil 92 is also mounted directly to the aluminum base 100 and second aluminum side panel (not shown). This also causes heat from the condenser coil 92 to be dissipated through the aluminum base 100. Excessive heat slows down the recovery process such that the dissipation of heat will speed up the process of recovering the refrigerant. The fan 106 is used to draw air through the aluminum rear end panel 104 and push it past the internal components in through the condenser coil 92. The shoulder strap attachments 108 and 109 are used to attach a shoulder strap such that the recovery unit 40 may be easily carried from place to place. Hour counter 110 is operable to continuously count the number of hours that the recovery unit 40 is in operation. This is displayed by a numeric display on the front surface of the aluminum front end panel 102. This is important since maintenance needs to be performed on the unit every 50 hours. The LED display 112 displays whether the system is in an "on" or "off" mode. The pressure gauge 114 displays the pressure at the inlet valve 42. This reading is displayed by an analog gauge on the front surface of the aluminum front end panel 102. Power cord 116 is used to provide power to the unit through power supply 126. The opposite end of power cord 116 is to be plugged into a standard three-prong outlet (not shown). The cut-off switch cord 120 is used to cut off the operation of the recovery unit 40 when the pressure in recovery tank (not shown) has reached a level such that the recovery tank is 80 percent full. This keeps the recovery tank from becoming overfull and thereby overpressurized.

Figure 3:
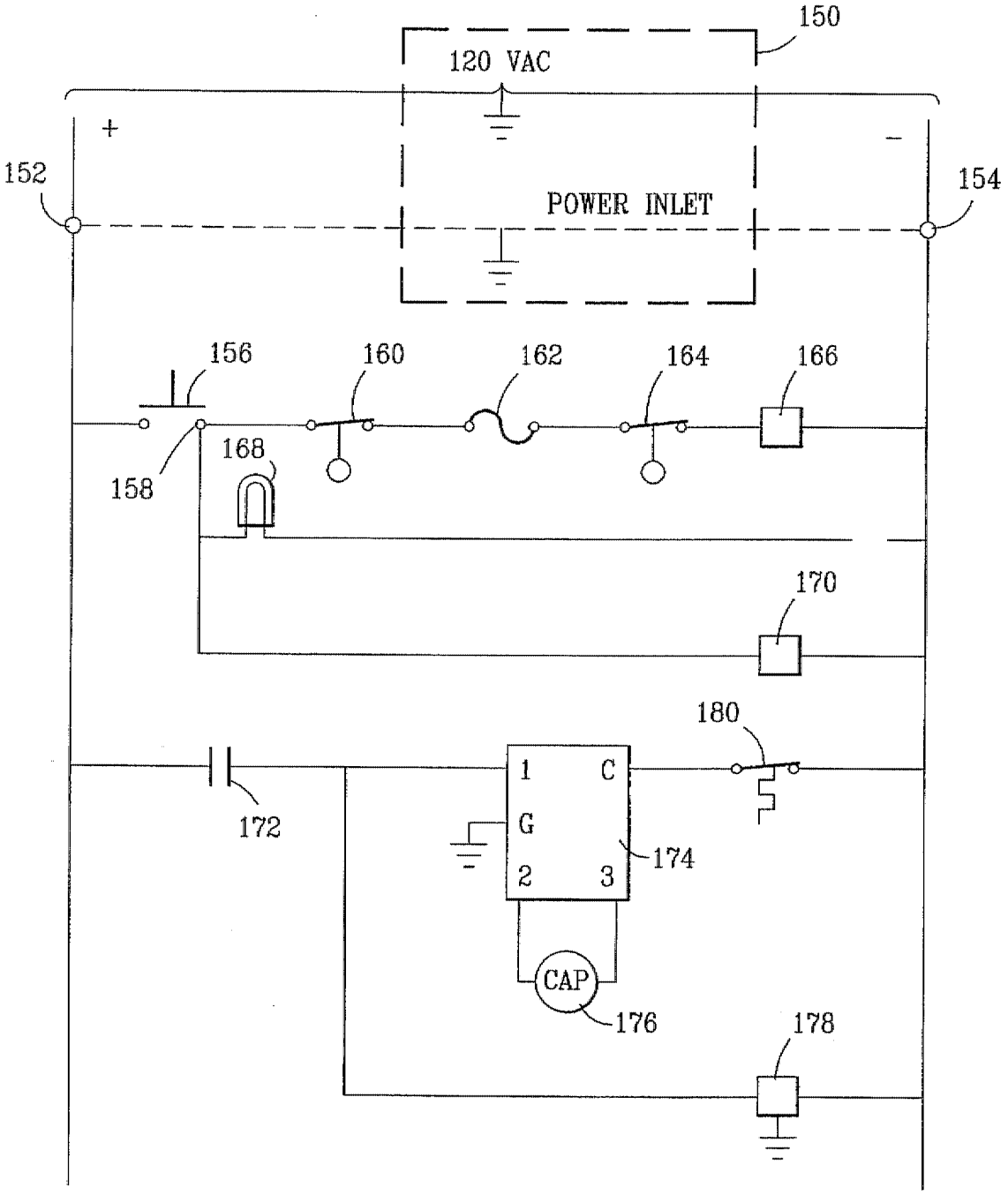
FIG. 3 illustrates a schematic diagram of the system of the present invention.

Referring now to FIG. 3, there is illustrated a schematic diagram of the system of the present invention. A 120 volt AC power supply 150 is provided. The positive side of power supply 150 is connected to a node 152 and the negative side of power supply 150 is connected to a node 154. A switch 156 is provided, one side thereof connected to node 152 and the other side thereof connected to a node 158. A pressure switch 160 is provided. A fuse 162, a tank level switch 164 and a compressor relay 166 are provided. The pressure switch 160 receives an input from a tank pressure sensor (not shown). The pressure switch 160 has one side thereof connected to the node 158, with the other side thereof connected to one side of the fuse 162. The other side of fuse 162 is connected to one side of the tank level switch 164, with the other side of switch 164 connected to the input of compressor relay 166. The output of compressor relay 166 is connected to node 154. Also connected to node 158 is a system "on" light 168. The other side of system "on" light 168 is connected to node 154. An hour meter 170 is provided with one side thereof connected to node 158 and the other side thereof connected to the node 154. A relay switch 172 is provided. The relay switch 172 is activated by the relay 166. One side of the relay switch 172 is connected to node 152. A compressor control 174 is provided having a first contact, a second contact, a third contact, a common contact and a ground contact. The first contact of compressor control 174 is connected to the second side of relay switch 172. The ground contact of compressor control 174 is connected to ground and the second and third contacts are connected across a run capacitor 176. A high temperature switch 180 is provided with one side thereof connected to the common contact of compressor control 174 and the other side thereof connected to the node 154. A fan control 178 is provided with one side thereof connected to the second side of relay switch 172, with the other side thereof connected to the node 154. Fan control 178 also has a ground connection connected to ground.

Power supply 150 has a positive side at node 152 and a negative side at node 154. The power flows from power supply 150 through node 152 to switch 156. Switch 156 functions as the system switch and the main power switch for the unit. If the switch is "off", switch 156 is open and power may not flow from node 152 to node 158. If the switch 156 is closed, switch 156 is "on" and power may flow freely from node 152 to node 158. Once node 158 is energized, system "on" light 168 is energized and lights up and hour meter 170 is energized and begins to count hours. Also from node 158, the power flows through pressure switch 160. Pressure switch 160 detects the pressure between the compressor and the oil separator/filter. When this pressure moves above a certain threshold, pressure switch 160 is open, thereby opening the circuit. After flowing through pressure switch 160, the current flows through fuse 162 to tank level switch 164, which senses the level of refrigerant in the recovery tank 16. When the level of refrigerant in the recovery tank 16 reaches 80 percent, tank level switch 164 is opened, thereby opening the circuit and not allowing current to pass. After flowing through tank level switch 164, the power flows through to compressor relay 166. When compressor relay 166 is energized, relay switch 172 is in a closed position, and when relay switch 166 is de-energized, relay switch 172 is opened. When relay switch 172 is closed, power may flow from node 152 to the compressor control 174 and the fan control 178. When power flows to the compressor control 174, the compressor is started, and when power flows to the fan control 178, the fan is started. Connected between the compressor and common node 154 is the high temperature switch 180. When the high temperature switch 180 senses a temperature which is higher than a given threshold, it is opened thereby shutting off the circuit from the common lead of the compressor control 174 to the common node 154, thereby shutting off the compressor.

In summary, there has been provided a refrigerant recovery system for recovering refrigerant from a cooling system. The refrigerant recovery system includes a compressor for compressing the refrigerant. An oil separator is also included for receiving incoming refrigerant before the refrigerant is drawn into the compressor. The oil separator has a helical coil disposed in a heat exchange relationship therewith for receiving the refrigerant after the refrigerant is compressed by the compressor, thereby cooling the refrigerant. A condenser coil is also included for receiving the refrigerant after the refrigerant has passed through the helical coil and further cooling the refrigerant, causing it to condense.

Although the preferred embodiment has been described in detail, it should be understood that various changes, substitutions and alterations can be made therein without departing from the spirit and scope of the invention as defined by the appended claims.

What is claimed is:

1. A refrigerant recovery system for recovering refrigerant from a cooling system, comprising:

a compressor for compressing the refrigerant;

a cylindrical oil separator having a cylindrical side wall and opposing ends for receiving incoming refrigerant before the refrigerant is drawn into said compressor, said oil separator having a helical coil disposed in a heat transfer relationship with said cylindrical side wall of said oil separator for receiving the refrigerant after the refrigerant is compressed by said compressor, thereby cooling the refrigerant;

a condenser coil for receiving the refrigerant after the refrigerant has passed through said helical coil for further cooling the refrigerant, causing it to condense;

an aluminum base for mounting one of said opposing ends of said oil separator directly thereto such that said aluminum base dissipates heat from said oil separator;

an enclosure defined on a lower end by said aluminum base, first and second aluminum end panels which are mounted on lower ends thereof to said aluminum base and extend upwards in a parallel alignment with one another, an aluminum top panel which extends between opposite ends of said first and second aluminum end panels from said aluminum base, at least one aluminum side panel which extends upward from said aluminum base and between first edges of said first and second aluminum end panels, and said condenser coil which extends between second edges of said first and second aluminum end panels, which are opposite of said first edges thereof, wherein said oil separator is disposed within said enclosure, between said first and second aluminum end panels, between said condenser coil and said at least one aluminum side panel, and between said aluminum base and said aluminum top panel;

a fan disposed proximate to one of said first and second aluminum end panels for forcing air into said enclosure, around said cylindrical oil separator, and through said condenser coil, and then exteriorly of said enclosure; and wherein said aluminum base, said first and second end panels, said aluminum top panel and said condenser coil are joined such that the air forced into said enclosure by said fan pressurizes an interior of said enclosure within which said oil separator is disposed.

2. The apparatus of claim 1 wherein said oil separator is comprised of a closed canister having an open, internal volume with said cylindrical side wall comprising a heat conductive material.

3. The apparatus of claim 1 wherein said oil separator comprises a substantially cylindrical construction wherein said helical coil exists in a heat exchange relationship with said cylindrical side wall.

4. The apparatus of claim 1, wherein said oil separator has an inlet and further comprising a pressure switch disposed at said inlet of said oil separator.

5. The apparatus of claim 1 and further comprising an oil drain disposed at the base of said oil separator for draining oil from said oil separator.

6. The apparatus of claim 1, further comprising two shoulder strap attachments, each disposed above respective ones of said first and second end panels.

7. A refrigerant recovery system for recovering refrigerant from a cooling system, comprising:

a compressor for compressing the refrigerant;

a cylindrical oil separator having a cylindrical side wall and ends for receiving incoming refrigerant before the refrigerant is drawn into said compressor, said oil separator having a helical coil disposed in a heat transfer relationship with said cylindrical side wall of said oil separator for receiving the refrigerant after the refrigerant is compressed by said compressor, thereby cooling the refrigerant;

a condenser coil for receiving the refrigerant after the refrigerant has passed through said helical coil and further cooling the refrigerant, causing it to condense;

an aluminum base for mounting one of said ends of said oil separator directly thereto such that said aluminum base dissipates heat from said oil separator;

first and second aluminum end panels which are mounted on lower ends thereof to said aluminum base and extend upwards in a parallel alignment with one another and at right angles to said aluminum base;

an aluminum top panel which extends between opposite ends of said first and second aluminum end panels from said aluminum base, parallel to said aluminum base and at right angles to said first and second aluminum end panels;

at least one aluminum side panel which extends upward from said aluminum base, between first edges of said first and second aluminum end panels, and at right angles to said aluminum base and said first and second aluminum end panels;

wherein said aluminum base plate, said first and second end panels, said aluminum top panel, said at least one aluminum side panel and said condenser coil together comprise an enclosure;

wherein said condenser coil extends between second edges of said first and second aluminum end panels, which are opposite of said first edges thereof, said condenser coil having two longer flat sides which extend at right angles to said aluminum base and said first and second aluminum end panels, wherein said cylindrical oil separator and said compressor are disposed within said enclosure, between said first and second aluminum end panels, between said condenser and said at least one aluminum side panel, and between said aluminum base and said aluminum top panel;

a fan disposed proximate to one of said first and second aluminum end panels for forcing air into said enclosure, around said oil separator and said compressor, and through said condenser coil, which is disposed at a right angle to said one of said first and second aluminum end panels, and then exteriorly of said enclosure; and wherein said aluminum base, said first and second end panels, said aluminum top panel and said condenser coil are joined such that the air forced into said enclosure by said fan pressurizes an interior of said enclosure within which said oil separator is disposed.

8. The apparatus of claim 7 wherein said condenser coil is also mounted directly to said aluminum base, such that said aluminum base dissipates heat from said condenser coil.

9. A method for recovering refrigerant from a cooling system, comprising:

mounting an oil separator directly to a heat conductive aluminum base in a heat conductive relationship therewith;

compressing the refrigerant using a compressor;

separating oil from the refrigerant using the oil separator having a cylindrical side wall and opposing ends for receiving incoming refrigerant before the refrigerant is drawn into the compressor, the oil separator having a helical coil disposed in a heat transfer relationship with the cylindrical side wall of the oil separator for receiving the refrigerant after the refrigerant is compressed by the compressor, thereby cooling the refrigerant;

condensing the refrigerant using a condenser coil for receiving the refrigerant after the refrigerant has passed through the helical coil for further cooling the refrigerant, causing it to condense;

disposing the oil separator within an enclosure, which includes the heat conductive aluminum base; and forcing air into the enclosure, around the oil separator mounted directly to the aluminum base, through the condenser coil, and then exteriorly of the enclosure, wherein the air is forced into the enclosure in a first direction which is substantially at right angles to a second direction at which the air is forced through the condenser coil; and wherein the step of forcing air into the enclosure pressurizes the air within the enclosure and around the oil separator.

10. The method of claim 9, wherein the oil separator is comprised of a closed cylindrical canister having an open, internal volume with the cylindrical side wall comprising a heat conductive material.

11. The method of claim 9, wherein the oil separator comprises a substantially cylindrical construction wherein the helical coil exists in a heat exchange relationship with the cylindrical side wall.

12. The method of claim 9, wherein the oil separator has an inlet and further comprising a pressure switch disposed at the inlet of said oil separator.

13. The method of claim 9, and further comprising the steps of draining the oil from the oil separator using an oil drain disposed at the base of the oil separator.

14. The method of claim 13 and further comprising the step of disposing the oil into the compressor.

15. A method for recovering refrigerant from a cooling system, comprising:

compressing the refrigerant using a compressor;

separating oil from the refrigerant using an oil separator having a wall and ends for receiving incoming refrigerant before the refrigerant is drawn into the compressor, the oil separator having a helical coil disposed in a heat transfer relationship with the wall of the oil separator for receiving the refrigerant after the refrigerant is compressed by the compressor, thereby cooling the refrigerant;

condensing the refrigerant using a condenser coil for receiving the refrigerant after the refrigerant has passed through the helical coil to further cool the refrigerant, causing it to condense;

mounting one end of the oil separator directly to a heat conductive aluminum base, such that the heat conductive aluminum base dissipates heat from the oil separator;

disposing the oil separator within an enclosure, which includes the heat conductive aluminum base; and forcing air into the enclosure, around the oil separator mounted directly to the aluminum base, through the condenser coil, and then exteriorly of the enclosure, wherein the air is forced into the enclosure in a first direction which is substantially at right angles to a second direction at which the air is forced through the condenser coil, and the first and second directions of air flow are substantially perpendicular to the aluminum base; and wherein the step of forcing air into the enclosure pressurizes the air within the enclosure and around the oil separator.

16. The method of claim 15 and further comprising the step of mounting the condenser coil to the aluminum base, such that the aluminum base dissipates heat from the condenser coil.

17. The apparatus of claim 6, further comprising:

a carrying handle secured to said top; and wherein said fan is disposed for passing air through one of said end panels.

* * * * *

UNITED STATES PATENT AND TRADEMARK OFFICE

CERTIFICATE OF CORRECTION

PATENT NO. : 5,671,605
APPLICATION NO. : 08/528619
DATED : September 30, 1997
INVENTOR(S) : Helterbrand It is certified that error appears in the above-identified patent and that said Letters Patent is hereby corrected as shown below:

| | | |
|---|---|---|
| Column 4, | line 15 | Replace "rear panel"<br>With -- rear end panel -- |
| Column 5, | line 13 | Replace "The aluminum base 10panel 102,<br>aluminum rear panel 102,<br>aluminum rear end panel 104, "<br>With -- The aluminum base 100, the<br>aluminum front end panel 102,<br>aluminum rear end panel 104, -- |
| Column 10, | line 34 | Replace "coil to the "<br>With -- coil directly to the -- |

Signed and Sealed this

Twenty-fourth Day of July, 2007

JON W. DUDAS
*Director of the United States Patent and Trademark Office*